350-452
8/13/85 XR 4,535,240

United States Patent [19]
Vigurs

[11] Patent Number: 4,535,240
[45] Date of Patent: Aug. 13, 1985

[54] INTRUDER DETECTION

[76] Inventor: John P. C. Vigurs, 7, Church Rd., East Molesley, Surrey, England

[21] Appl. No.: 535,384

[22] Filed: Sep. 23, 1983

[51] Int. Cl.[3] ..... B42F 13/00
[52] U.S. Cl. ..... 250/342; 350/452
[58] Field of Search ..... 250/342, 353; 350/452, 350/437

[56] References Cited

U.S. PATENT DOCUMENTS

| | | | |
|---|---|---|---|
| 3,203,306 | 8/1965 | Lefferts | 350/452 |
| 4,050,782 | 9/1977 | Uchida et al. | 350/452 |
| 4,321,594 | 3/1982 | Galvin et al. | 350/452 |

FOREIGN PATENT DOCUMENTS 2064108 6/1981 United Kingdom .

*Primary Examiner*—Alfred E. Smith
*Assistant Examiner*—Vincent J. Lemmo, Jr.
*Attorney, Agent, or Firm*—Lewis Messulam

[57] ABSTRACT

The invention relates to an intruder detector for use in a burglary in which infra-red radiation is imaged onto a sensor 16. The imaging system, which serves to divide the area of surveillance into monitored and unmonitored zones and to focus the radiation onto the sensor, consists of a window 12 constructed as a flat one-piece segmented Fresnel lens, each segment 12*a,* 12*b* and 12*c* focusing energy from a different respective monitored zone onto the sensor 16. The lens is double sided with one side acting as a convex lens and the other as a set of deflecting prisms.

6 Claims, 3 Drawing Figures

INTRUDER DETECTION

The present invention relates to an intrusion detector for use as part of a burglar alarm.

Intrusion detectors are known which operate on the basis of detecting the infra-red radiation emitted by an intruder. The semiconductor devices used in such detectors as sensors are responsive only to changes in the incident radiation and it is therefore necessary to ensure that as an intruder moves about the area under surveillance, the infra-red energy imaged onto the semiconductor device varies.

The usual manner of achieving this aim is to divide the area of surveillance into monitored and unmonitored zones so that as an intruder moves from one such zone to another a significant change occurs in the amount of infra-red radiation falling on the semiconductor device and thereby enables detection.

The known manner for dividing the area of surveillance into monitored and unmonitored zones is to use a multifaceted mirror but such a construction is both expensive to produce and results in a bulky and obtrusive detector.

With a view to mitigating the above disadvantages, the present invention provides an intruder detector comprising a sensor responsive to changes in the level of incident radiation and an imaging system for focusing energy from only monitored zones of an area of surveillance onto the sensor, the imaging system comprising a window constructed as a flat, integrally formed, segmented Fresnel lens of which each segment is operative to focus radiation from a different respective monitored zone onto the sensor.

Conveniently, the Fresnel lens comprises a sheet of material transparent to infra-red radiation having concentric formations on one surface to define a convex focusing lens common to all the segments and on the opposite surface of the lens segment comprises parallel formations to act as a deflecting prism, the angle of deflection or the attitude of the prism varying from one segment to another whereby to divide the area of surveillance into monitored and unmonitored zones.

Advantageously, the material from which the window is made is a mouldable plastics material such as polyethylene.

The invention will now be described further, by way of example, with reference to the accompanying drawings, in which.

Figure 1:
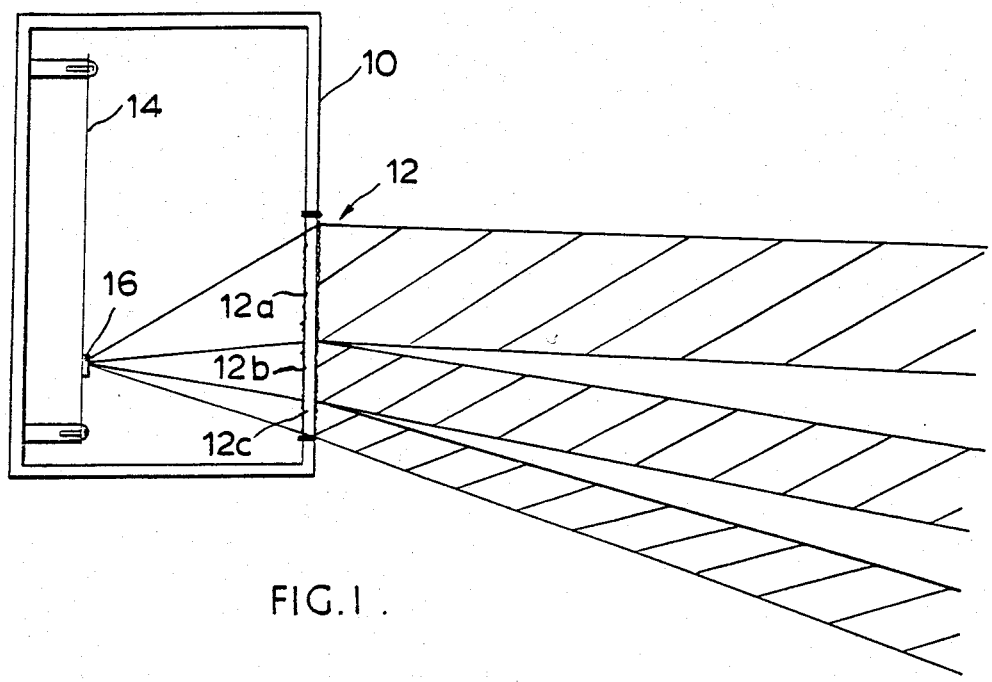
FIG. 1 is a schematic diagram of an intruder detector.

In FIG. 1, there is shown an intruder detector in the form of a box 10 having a window 12. A printed circuit board 14 is mounted within the box 10 and carries an infra-red sensor 16. The circuit and the sensor will not be described in detail as they are conventional and are not directly related to the improvement provided by the invention.

Figure 2:
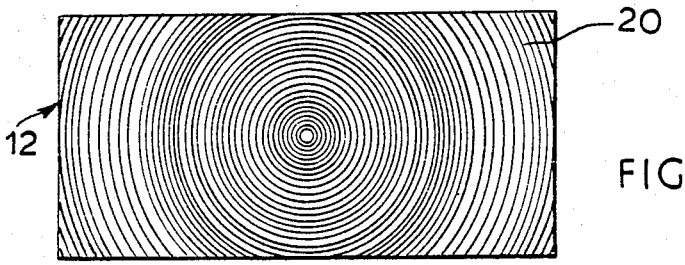
FIG. 2 is a view of one face of the window of the detector shown in FIG. 1.

As previously described, it is necessary to divide the area of surveillance into monitored and unmonitored zones. This is achieved by virtue of the fact that the window 12 is constructed as a double-sided, flat, segmented Fresnel lens. As seen from FIG. 2, one face of the Fresnel lens consists exclusively of concentric formations 20 so that this surface acts in a known manner as a convex lens to focus the incident radiation onto the sensor 16.

Figure 3:
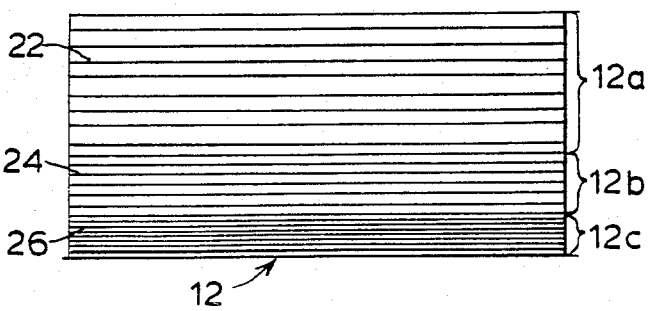
FIG. 3 is a view of the opposite face of the same window.

On the opposite side, as shown in FIG. 3, there are three sets of parallel formations 22, 24 and 26 each forming part of a respective one of three segments 12*a*, 12*b* and 12*c* of the window. The first segment 12*a* has widely spaced formations 22 each of which is triangular in cross-section with a small apical angle. The second segment 12*b* has less widely spaced formations 24 with a larger apical angle while the third segment 12*c* has still less widely spaced formations with still larger apical angle. As a consequence of this construction each segment acts as a deflecting prism and, as shown diagrammatically in FIG. 1, the window collects radiation from three different monitored zones (shaded) which are separated from one another by unmonitored zones.

It will be noted that the window segment 12*a* for the long range zone has a larger area than segment 12*b* for the medium range zone which, in turn, has a larger area that the segment 12*c* for the short range zone. This variation in the effective aperture of the imaging system is intended to counteract the fact that the energy from an intruder reduces with his distance, following an inverse square law.

The construction of the window in this manner obviates the need for multi-faceted mirrors which require a great deal of space. Furthermore, the window may be made relatively large to achieve the required sensitivity and the energy losses can be reduced as compared with a mirror system. The main advantage, however, stems from the important reduction in manufacturing costs in that the entire imaging system can be formed integrally using a simple moulding technique from polyethylene which is an inexpensive plastics material. The window can furthermore be assembled with ease and makes for a neater and more compact design.

It is claimed:

1. An intruder detector comprising a sensor responsive to changes in the level of incident radiation and an imaging system for focusing energy from only monitored zones of an area of surveillance onto the sensor, the imaging system comprising a window constructed as a flat, integrally formed, segmented Fresnel lens of which each segment is operative to focus radiation from a different respective monitored zone onto the sensor.

2. An intruder detector as claimed in claim 1, wherein the Fresnel lens comprises a sheet of material transparent to infra-red radiation having concentric formations on one surface to define a convex focusing lens common to all the segments and having on the opposite surface parallel formations defining segments each of acts as a deflecting prism, the angle of deflection or the attitude of the prism varying from one segment to another whereby to divide the area of surveillance into monitored and unmonitored zones.

3. An intruder detector as claimed in claim 2, wherein the areas of segments imaging radiation from distant objects onto the sensor are greater than the areas of segments imaging near objects onto the sensor.

4. An intruder detector as claimed in claim 1, wherein the window is constructed from polyethylene.

5. An intruder detector as claimed in claim 2, wherein the window is constructed from polyethylene.

6. An intruder detector as claimed in claim 3, wherein the window is constructed from polyethylene.

* * * * *